United States Patent [19]

Marrast et al.

[11] Patent Number: 4,803,874

[45] Date of Patent: Feb. 14, 1989

[54] DEVICE AND METHOD FOR DETERMINING THE ORIENTATION OF FRACTURES IN A GEOLOGICAL FORMATION

[75] Inventors: Jacques Marrast, Marly Le Roi; Andre Pauc, Villennes S/Seine; Christian Wittrisch, Rueil-Malmaison, all of France

[73] Assignee: Institut Francais du Petrole, Ruel-Malmaison, France

[21] Appl. No.: 947,751

[22] Filed: Dec. 30, 1986

[30] Foreign Application Priority Data

Dec. 30, 1985 [FR] France ..... 85 19464

[51] Int. Cl.[4] ..... E21B 47/10

[52] U.S. Cl. ..... 73/155

[58] Field of Search ..... 73/155, 38; 166/254; 33/302

[56] References Cited

U.S. PATENT DOCUMENTS 4,043,192 8/1977 Shuck ..... 73/155

*Primary Examiner*—Jerry W. Myracle

*Attorney, Agent, or Firm*—Antonelli, Terry & Wands

[57] ABSTRACT

A device and method are provided for determining, from a well, the orientation of fractures in a geological formation having a fracture zone. The device includes a tubular element connected to a hydraulic fluid source and having at least one flow orifice through which the fluid may escape. This device further includes:

(a) at least one chamber through which the fluid may flow from the tubular element towards the fracture, this chamber being in communication with the flow orifice, (b) at least one mobile orientation element situated substantially at the same depth as the fracture zone, this element being articulated about the tubular element and being adapted for moving by rotation towards a final position following discharge of the fluid from the chamber towards the fracture zone, and (c) an arrangement for locating the final position of said orientation element, this position being in relation with the orientation of the fracture.

13 Claims, 3 Drawing Sheets

DEVICE AND METHOD FOR DETERMINING THE ORIENTATION OF FRACTURES IN A GEOLOGICAL FORMATION

BACKGROUND OF THE INVENTION

1. Field of the Invention

The present invention relates to a device and method for measuring the orientation of the fractures or drains in a geological formation.

It applies to the field of fossile energy production and more particularly to the stimulation of reservoirs and relates both to vertical wells and to deflected wells.

2. Description of the Prior Art

Hydraulic formation fracturing consists in cracking the productive rock by increasing a fluid pressure in the well and maintaining the crack thus created open. It develops along a plane whose orientation depends on the forces exerted on the reservoir:

the main vertical force due to the weight of the sediments ($\sigma_1$), the main horizontal stresses which depend in particular on the tectonics of the side ($\sigma_2$ and $\sigma_3$).

The fracture plane develops perpendicularly to the lowest of these three stresses the fracture will in general be horizontal at a small depth (less than 600 m), the vertical stress being smaller than the two horizontal stresses, and vertical for greater depths, fracturing being perpendicular to the smallest of the two horizontal stresses.

Hydraulic fracturing is sometimes used for connecting two wells at the level of a geological formation, for example for carrying out the underground gasification of a cold air whose permeability is too low to provide, between the two wells, the gas flow rate required for maintaining back combustion.

It is also used for providing the connection between two wells in the case of high enthalpy geothermy, or for seeking better scavenging of an oil deposit by forming a drain which distributes the injection of water charged with chemical additives.

For all these methods, knowledge of the direction taken by the fracture created is essential. If such knowledge is indispensable when it is a question of using the fracture for connecting the two wells together, it is not less important for a simple stimulation where only an improvement in the productivity of the well is sought; in fact, if the fracture is directed towards the oil-water limit, it will cause premature submersion of the well which will cause its closure, instead of the expected increase in oil production.

It is known to seek the direction of a fracture by observing the wall of a well through an oriented television camera, or by using the technique of printing packer. A sealing member or packer equipped with a deformable membrane is lowered and anchored in the layer before and after fracturing. The fracture is visible on the membrane of the packer which has an orientation detection device.

These methods can only apply to uncased wells and imposes bringing the well to a long halt for putting in the apparatus and for their withdrawal.

It is also known to determine the fracture direction by an acoustic detection of the advance of the fracture, this detection can be remotely achieved when the well is not outfit and preferably uncased at less than 100 m from the fractured well.

Geophones or accelerometers applied against the wall detect noises related to the fracturing. However, the availability of such a listening well is fairly uncertain and, in addition, with the present interpretation methods, a direction even approximative of the fracture cannot be derived from the numerous noises recorded, for the time being.

SUMMARY OF THE INVENTION

The device of the present invention overcomes these drawbacks, for its purpose is to determine, at the beginning and/or during fracturing, a fracture direction from a well not only cased and perforated but also an uncovered well and to limit the loss of time on the well by easy, rapid and inexpensive setting up, the apparatus forming in fact part of the fracturing packing itself and requires no additional manoeuvers.

The object of the invention is also to determine the values of the stress.

The invention provides a device for determining the orientation of fractures and drains in a geological formation having a substantially vertical or oblique fracture zone from a well, this device including a tubular element whose cross section is substantially circular, said tubular element being connected to a hydraulic fluid source and having at least one flow orifice through which the fluid may escape.

This device comprises more particularly in combination:

(a) at least one chamber through which said fluid may flow from said tubular element towards the fracture, this chamber being in communication with said flow orifice, (b) at least one mobile orientation element situated substantially at the same depth as the fracture zone, being mounted for rotation about said tubular element and being adapted for moving by rotation to a second final position following discharge of said fluid from said chamber to the fracture zone, and (c) means for detecting or measuring said final position of said orientation element, said final position being in relation with the orientation of the fracture.

The invention also provides a method for determining the orientation of fractures or drains in a geological formation having a substantially vertical or oblique fracture zone, from a well. In this method, a hydraulic fluid is introduced into a tubular element having at least one flow orifice, the fluid is caused to flow through a mobile orientation element situated substantially at the same depth as the fracture zone while letting the fluid escape through at least one outlet orifice in a direction, preferably inclined with respect to the axis of the well, so as to cause said orientation element to move by rotation as far as a final position in relation with the orientation of the fracture and said position is located.

The orientation element may be moved in line with the fracture and then be in a position in direct relation with the orientation of the fracture, or it may be moved towards a position which may or may not be facing the fracture if the device is provided with a return member, for example, which may be correlated, through calibration for example, with the orientation of a fracture.

In another embodiment of the invention, said tubular element includes at least one flow orifice situated substantially along at least one generatrix. It may also comprise at least two diametrically opposite mobile orientation elements.

In a particularly advantageous embodiment, the device includes a tubular element with at least one flow orifice disposed along a generatrix, at least one fixed blade disposed parallel to the axis of said element and situated in the immediate vicinity of said flow orifice, at least one mobile blade disposed parallel to the axis of the tubular element, said mobile blade being separated from said fixed blade by said flow orifice, said mobile blade being articulated about said element while defining a chamber with said fixed blade, said chamber being in communication with said flow orifice, said mobile blade being adapted for moving by rotation from an initial position defined by a return member to said final position corresponding to discharge of said fluid from said chamber towards said fracture zone.

The hydraulic fluid injected may be advantageously water, or a viscous liquid which may contain chemical additives even propping agents, such as sand or zirconium balls for example.

The pumping rate allowing the device to operate is between 0.1 and a few tens of $m^3$ per minute and preferably between 1 and 2 $m^3$ per minute.

For determining the direction of a fracture, it is necessary first of all to determine the orientation, i.e. the angular position $\theta$ of the mobile part or window directed towards the fracture with respect to a reference generatrix of the probe fixed to the end of the tubular element.

Then the angle of this reference generatrix of the probe is determined with respect to a geographical reference which may be either the magnetic or geographic North, or a vertical reference plane passing through the axis of the well or of the probe, that is to say either the azimuth $\alpha$ in the case of vertical wells, or in the case of deflected wells the azimuth $\alpha$, the slant i and the angle of rotation u between the planes defined by the axis of the well (or of the probe) and the reference generatrix, on the one hand, and the vertical direction and the axis of the well on the other.

The azimuth $\alpha$ is the angle formed between the projection of the direction of the magnetic North on the horizontal plane and the projection of the axis of the well of the probe on the horizontal plane.

The slant i is the angle which the axis of the well forms with the vertical whereas the angle of rotation u is formed between the vertical plane passing through the axis of the probe and the plane passing through the reference generatrix and the axis of the probe.

The above described means for measuring these different angles are known and will not be described in detail. A combination thereof however answers the problem raised, namely the measurement of the orientation of the mobile part with respect to the position of a reference generatrix of the probe and consequently the direction of the fracture can be determined.

Thus the value of an angle $\theta+$ or $-\alpha$ is measured in the case of a vertical well and $\theta$, $\alpha$, i, u in the case of a deflected well.

The angle $\theta$ may be obtained, in all cases, by at least one proximity sensor associated for example with small magnets.

In addition, if the well is vertical, in the presence of a non magnetic medium, a magnetic compass may be used for measuring $\alpha$ and in the presence of a magnetic medium a gyroscope.

On the other hand, if the well is deflected, in a non magnetic environment, a compass or magnetometers may be used for determining the angle $\alpha$ and inclinometers for the angle i, and in a magnetic medium, a gyroscope and inclinometers.

If furthermore, the azimuth $\alpha$ and the slant i are known which are constant values which only depend on the drilling, only the angle u is measured, by means of a transverse pendulum cooperating with a potentiometric track or by means of two or three static accelerometers. It is then combined with the angle $\theta$ under the form u+ or $-\theta$.

The locating means may then include the probe with its different measuring apparatus, this probe being:

(a) adapted to the fixed tubular element and operating with an electronic memory, (b) connected to the surface through a logging cable and resting for example on a seat. The electric cable conveys the information to the surface, (c) connected to an electric bottom connector, known per se, the connection being formed once the assembly has been lowered to the level of the fracture.

The compass, the inclinometers and the static accelerometers are fixed to the probe (fixed part) whereas the instrument measuring the angular position is formed of a fixed part having at least one proximity sensor fixed to the probe or to the tubular element, this sensor cooperating with a mobile, part, formed by a plurality of magnets, disposed for example on the mobile orientation element.

BRIEF DESCRIPTION OF THE DRAWINGS

The invention will be well understood and all its advantages will be clear from reading the following description, illustrated by the accompanying Figures in which.

DESCRIPTION OF THE PREFERRED EMBODIMENT

Figure 2:
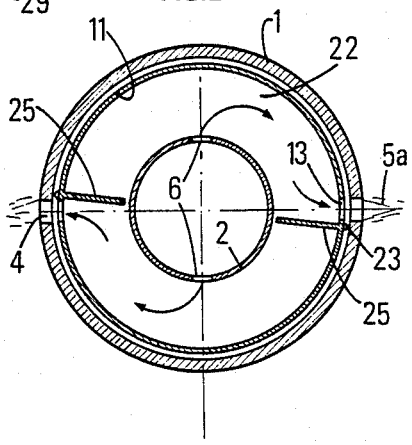
FIG. 2 shows a cross sectional view through a plane AA.

The reference 20 in FIG. 2 designates a deflected or vertical oil well and the reference 21 the device of the invention for detecting the orientation of a fracture 5 to be created or present in a geological formation 5*a*.

In this well 20, a casing 1 is positioned in a way known per se. It has a zone 4 which has been perforated by known means and which is placed in the immediate vicinity of the geological layer 5*a* containing the fracture 5 or in which it is desired to form a fracture 5. Of course, the perforations 4 are formed in the different radial directions. In the different Figures only the perforations 4 have been shown which are adjacent the fracture and through which there will be a flow of fluid. At the depth of geological formations containing oil or gas, the fractures will be rather substantially vertical or oblique with respect to the longitudinal axis of the well.

The device 21 of the invention is positioned at the surface on a tubular element 2 before being lowered into the well. This tubular element 2 is pierced with at least one flow orifice 6 in its lower part. Device 21 is formed of a rotating element or cage mounted on bearings 12*a* and 12*b* providing easy rotation of cage 11 about the tubular element 2. This rotating element 11 in the form of a volume of revolution is located substantially at the same level as the fracture zone and is in communication with the flow orifice 6. It defines a chamber 22 and has at its periphery an outlet orifice 13 in the form of a slit or hole or a plurality of holes disposed substantially along a generatrix of the volume of revolution or in the immediate vicinity of the generatrix. This orifice 13 forms a mobile orientation element.

Advantageously (FIG. 2), the element 11 may include, for promoting rotation thereof, at least one blade 25 situated in the immediate vicinity of orifice 13 between the tubular element 2 and cage 11 and whose length is such that this blade does not touch the tubular element 2. Excellent results are obtained when element 11 has two diametrically opposite blades.

Furthermore, the rotating element 11 includes a plurality of magnets 14, for example, which form the mobile part and which are associated with at least one proximity detector or sensor 15 connected by a connection 29 to the electric cable 9. This sensor is fixed to probe 10. The other apparatus 8, such as a compass, accelerometers, inclinometers, magnometers, and gyroscope are disposed on the probe. In this embodiment only the magnets 14 are fixed to the mobile element 11 and the measuring system (15, 8) may be raised by cable 9 with probe 10.

The orifices 4, 13 and 6 are therefore substantially at the same depth as the fracture 5 whose direction it is desired to determine.

A packer 3*a* provides sealing upstream of device 21 between casings 1 and 2 as well as centering of the installation.

Another packer 3*b* may possibly provide sealing downstream if the space between the rotary element 11 and casing 1 or the wall of the well proved to be too great.

The detection or locating means (probe with its measuring instruments) is lowered by an electric cable 9 controlled from the surface substantially below the fractured zone and comes into contact with a stop 7 forming a seat.

The probe thus comes off the base of the tubular element 2. Sealing may also be provided through a satisfactory tension of cable 9 from the surface.

Figure 1:
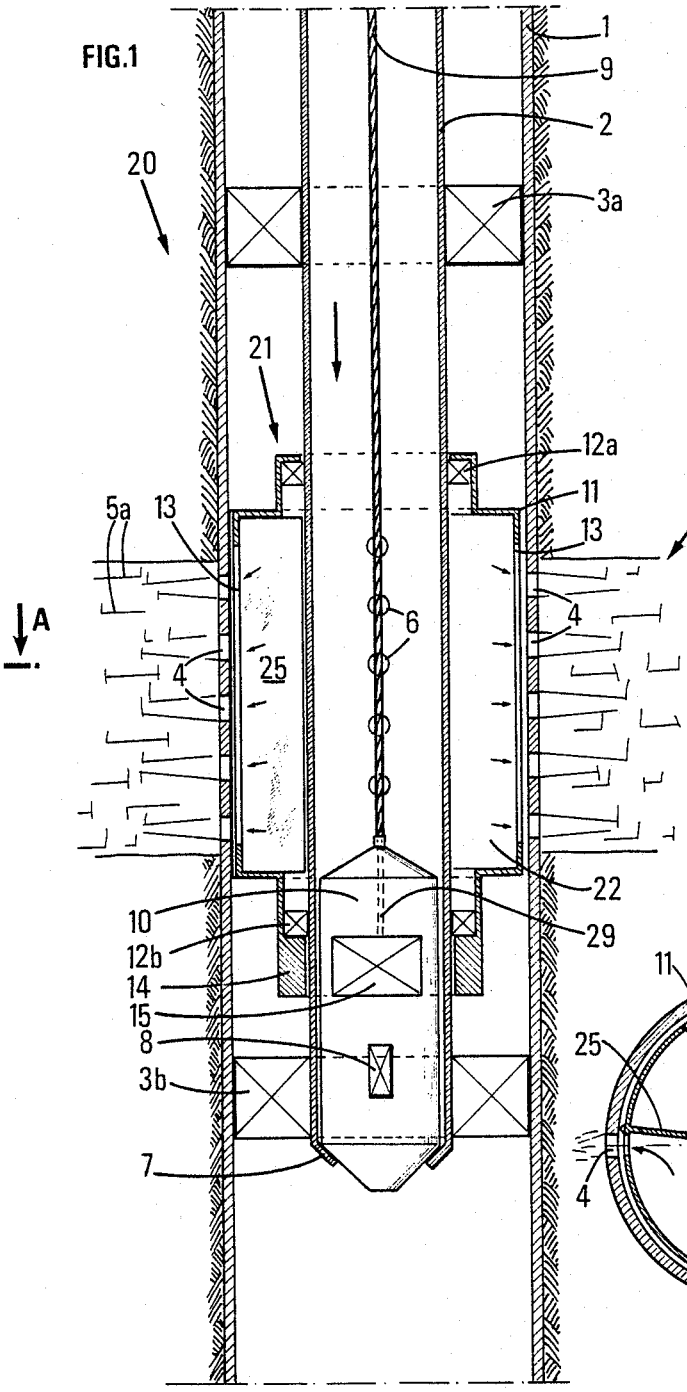
FIG. 1 shows a detailed view of the device of the invention.

In FIGS. 1 and 2, chamber 22 is annular and closed, possibly by the detection means. The tubular element 2 includes at least one radial orifice 6.

The information is either treated at the surface or stored and treated after the probe 10 has been raised to the surface where the operations are also carried out for controlling and monitoring the pumping of the hydraulic fluid delivered by a pump, for example from the surface.

Means of a known type not shown in the Figure, housed in the probe allow the value of the stress to be determined.

In FIG. 2, taken through plane AA, the tubular element 2 includes two diametrically opposite flow orifices 6 and the rotary element 22 also has two diametrically opposite outlet orifices 13.

This configuration facilitates the drive torque for the mobile assembly. At least one means 23 (restriction lip for example) may be advantageously provided on the external edge of orifice 13 for introducing a dissymmetric pressure loss in the path of the fluid.

Figure 3:
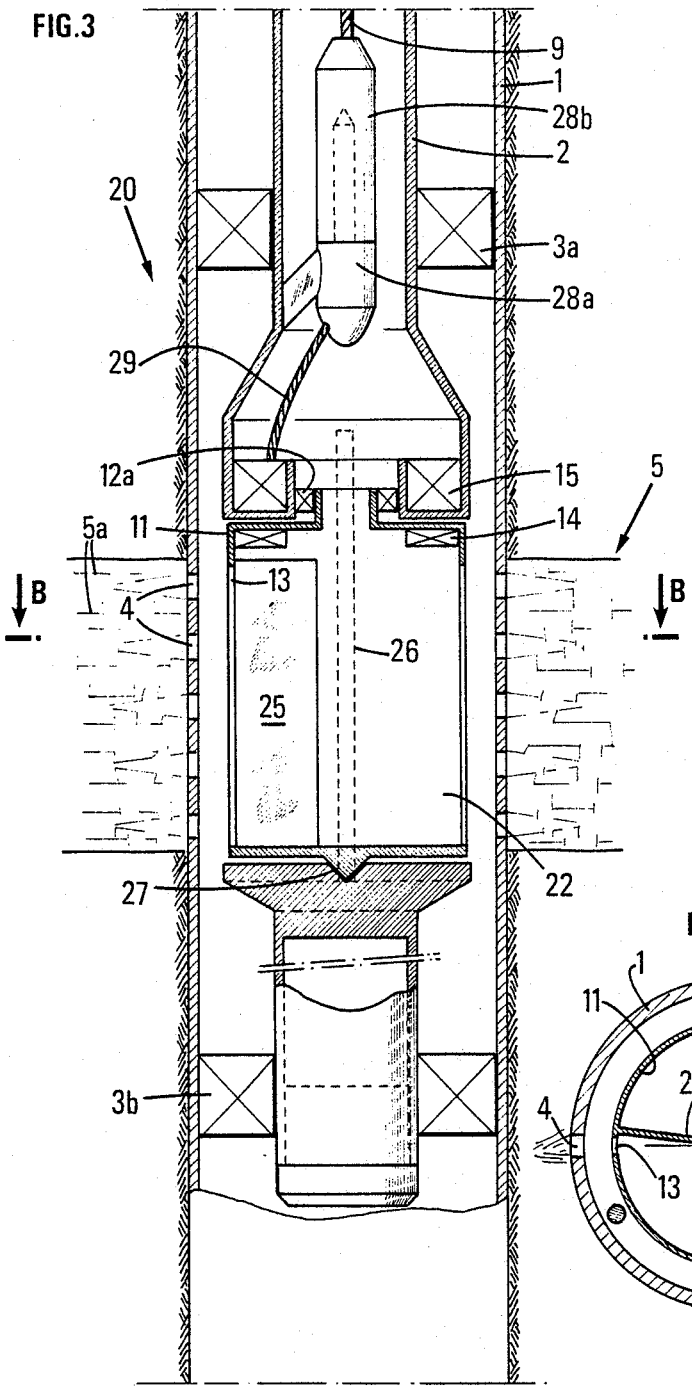
FIGS. 3 and 3A show a variant of construction of the device.
Figure 3A:
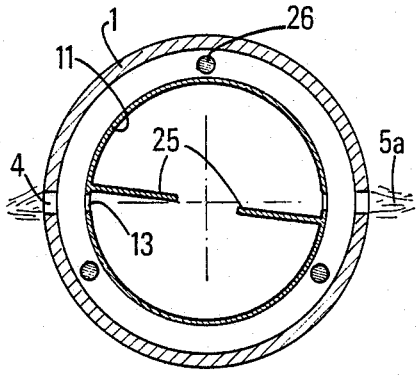

In another embodiment illustrated in FIGS. 3 and 3A (section through BB), chamber 22 is cylindrical and the base of cage 11 provides sealing.

Cage 11 may possibly include blades 25 facilitating rotation thereof and is supported by at least two reinforcement elements 26, attached to the fixed tubular element 2, the cage resting on a guide member 27 such as a pointed projection. The reinforcement elements 26 and the guide member 27 also maintain the cage in position at the time of pumping and react to the effects of the pressure of the fluid on the base of the cage.

Magnets 14 are disposed on cage 11 and the proximity sensors 15, fixed to the tubular element 2, are connected by a connection 24 to a male connector 28*a* to which a female connector 28*b* of cable 9 is coupled.

Thus, the above described rotation measurement system and magnets 14 are lowered at the same time as the tubular element and the measurement signal, taken over by the bottom electric connector (28*a*, 28*b*) is transmitted to the surface by cable 9.

Figure 4:
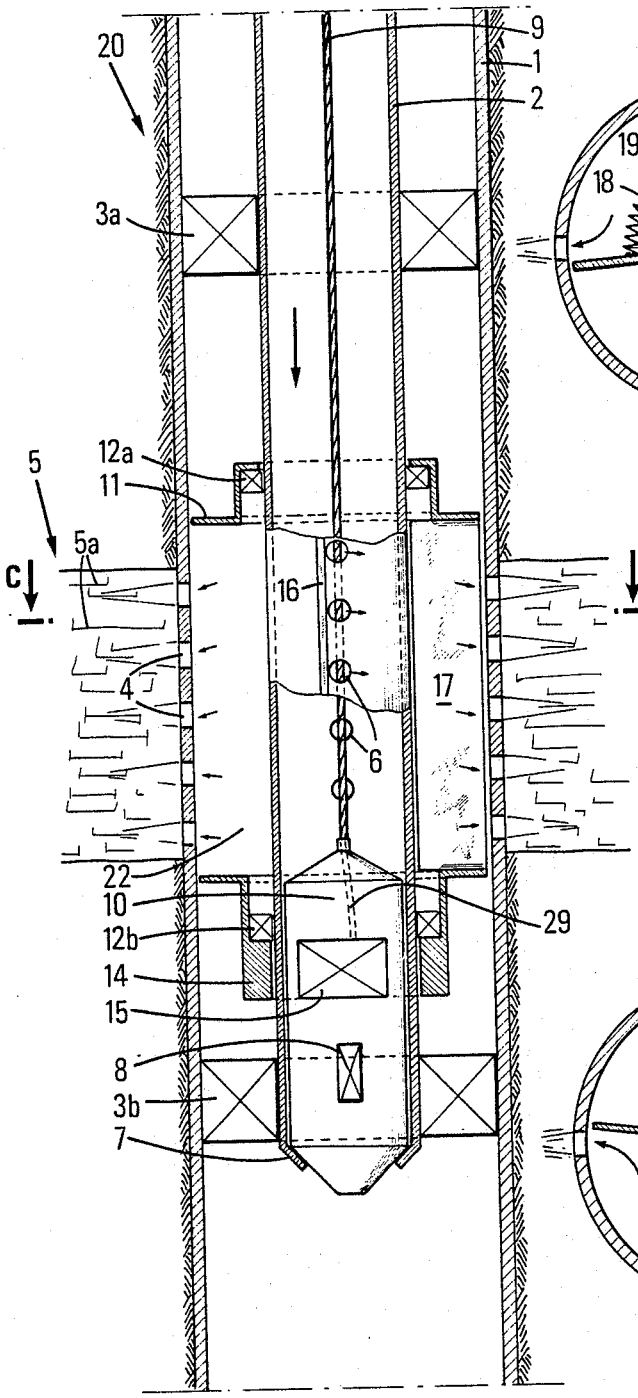
FIGS. 4 and 5 illustrate a particularly advantageous embodiment.
Figure 5:
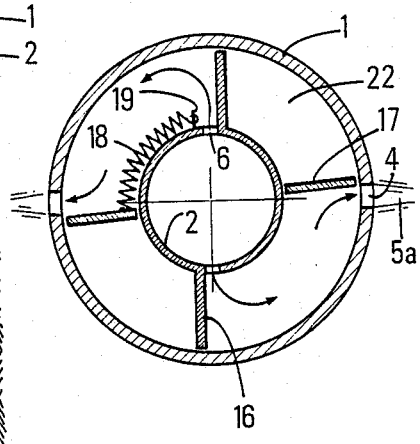

In another embodiment shown in FIGS. 4 and 5 (section through CC) the rotary element 11 mounted on bearings 12*a* and 12*b* includes two mobile blades 17 of rectangular shape for example and diametrically opposite, whereas the tubular element 2 has two flow orifices in the immediate proximity of which are situated two diametrically opposite fixed blades 16.

A return member 18 of known type holds the mobile blades 17 in a reproducible and perfectly known rest position, that is to say that they substantially face the fixed blades 16 while being separated by the flow orifice 6.

A butt 19 may possibly stop the action of the return member 18 (FIG. 5).

Figure 6:
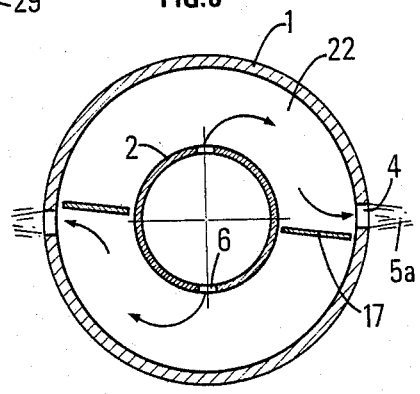
FIG. 6 shows another variant of the device.

Without departing from the scope of the present invention, the form of the free and mobile blades or of the fluid flow and outlet orifices may by modified or the fixed blades may be omitted as well as the return members such as illustrated in FIG. 6.

The operation of the device, illustrated in FIG. 1, is as follows:

Into a cased and perforated well 20, vertical for example, or into an uncased well a tubular element 2 is lowered equipped with two sealing members and the flow orifices 6 of which will come substantially at the level of the fractured layer.

The rotary element 11 which is screwed substantially facing the zone to be fractured 5 is lowered on this element 2. The sealing packer 3*a* is then anchored to the casing above the zone. Then the measuring element 10 which will be positioned against the stop 7 is lowered by means of the electric cable 9. The initial position $\alpha$ of the system is determined.

A pressurized hydraulic fluid (gel) is fed by the surface pumping installations at a flow rate of 1 $m^3$/min which flows first of all inside the tubular element 2, then flows into the chamber 22 through the flow orifices 6 and is finally discharged to the fracture zone by moving the mobile orientation element (mobile blades, FIG. 4: 17,; FIG. 1: 11 and 13) which will be positioned opposite the fracture, thus indicating a final direction corresponding to the direction of the fracture, or the angular position $\theta$.

This direction is then measured by the system of magnets 14 and proximity sensors 15 and the information is stored or sent to the surface for processing (determination of the magnitude $\theta+$ or $-\alpha$).

It is possible if required to carry out a second measurement by releasing the seal and by lowering the assembly of devices 2, 21 to a depth where a second fracture zone is to be studied and by repeating the above described operation.

When the operation is finished, it only remains to raise the measuring elements 10 by means of cable 9, which frees an optimum passage through the casing 2.

As regards the device illustrated in FIG. 3, the rotational measuring systems are lowered at the same time as the tubular element. After the sealing elements 3*a* and/or 3*b* have been anchored and the parameters α if the well is vertical and u if the well is deflected have been measured, the bottom electric connector 22*b* is lowered by means of cable 9 and this connector 28*b* is coupled to the measuring device. The fluid is then pumped and the angular position (rotation) of the rotary element 13, 11 indicating the direction of the fracture is measured.

What is claimed is:

1. A device for determining the orientation of fractures or drains in a geological formation having a substantially vertical or oblique fracture zone, from a well, including a tubular element whose cross section is substantially circular, said tubular element being connected to a hydraulic fluid source and having at least one flow orifice through which the fluid may escape, including in combination:

(a) at least one chamber through which said fluid may flow from said tubular element towards the fracture, this chamber being in communication with said flow orifice, (b) at least one mobile orientation element situated substantially at the same depth as the fracture zone, this element being mounted for rotation about said tubular element and being adapted to move by rotation towards a final position, following discharge of said fluid from said chamber towards the fracture zone, and (c) means for locating said final position of said orientation element, said final position being in relation with the orientation of the fracture.

2. The device as claimed in claim 1, wherein said tubular element has at least one flow orifice situated along at least one generatrix.

3. The device as claimed in one of claims 1 and 2, having at least two diametrically opposed mobile orientation elements.

4. The device as claimed in claim 1, wherein said mobile orientation element includes at least one outlet orifice and at least one means creating a pressure loss on the external surface of said orientation element and in the vicinity of said outlet orifice.

5. The device as claimed in claim 1, wherein said tubular element has at least one flow orifice disposed along a generatrix, at least one fixed blade disposed parallel to the axis of said element and situated in the immediate vicinity of said flow orifice, at least one mobile blade disposed parallel to the axis of the tubular element, said mobile blade being separated from said fixed blade by said flow orifice, said mobile blade being articulated about said element for defining a chamber with said fixed blade, said chamber being in communication with said flow orifice, said mobile blade being adapted to move by rotation from an initial position determined by a return member to said final position corresponding to the discharge of said fluid from said chamber towards the fracture zone.

6. The device as claimed in claim 1 or claim 5, wherein said tubular element includes at least two flow orifices situated substantially along two substantially diametrically opposite generatrices.

7. The device as claimed in claim 1, wherein said location means includes a probe having means for measuring the angle α of a location generatrix with respect to a reference or azimuth, means for measuring the angle i which the axis of the well forms with the vertical, or slant, and means for measuring the angle of rotation u formed by the vertical plane passing through the probe and by the plane passing through the location generatrix and the axis of the probe, said probe further having at least one detection member cooperating with complementary detection means including magnets which are fixed to said mobile orientation element, the assembly of these members being adapted for determining the position of said mobile orientation element with respect to said fixed probe.

8. The device as claimed in claim 1, wherein said chamber is annular and is situated about said tubular element, said tubular element having at least one radial orifice and being closed at its lower end.

9. The device as claimed in claim 1, wherein said tubular element is closed by said location means.

10. The device as claimed in claim 1, wherein said chamber is cylindrical and includes complementary detection members with at least one proximity detection member disposed on the tubular element, said proximity detection member being connected to an electric cable by a bottom electric connector.

11. The device as claimed in claim 1, further comprising at least one sealing element about said tubular element.

12. A method for determining the orientation of fractures or drains in the geological formation having a substantially vertical or oblique fracture zone, from a well, including the introduction of a pressurized hydraulic fluid into a tubular element having at least one flow orifice, wherein the fluid is caused to flow through a mobile orientation element situated substantially at the same depth as the fracture zone while letting the fluid escape through at least one outlet orifice in a slanting direction with respect to the axis of the well, so as to cause the orientation element to move by rotation to a final position in relation with the orientation of the fracture and said position is located in relation with the orientation of the fracture.

13. The method as claimed in claim 12, wherein the fluid is caused to flow at a rate between 0.1 and a few tens of $m^3$ per minute.

* * * * *